US005100030A

United States Patent [19]

Roggenburg, Jr. et al.

[11] Patent Number: 5,100,030

[45] Date of Patent: Mar. 31, 1992

[54] FIXTURES FOR FLUID DISPENSING BAGS

[75] Inventors: Stanley L. Roggenburg, Jr., Staten Island, N.Y.; Robert H. Laauwe, Franklin Lakes, N.J.; John L. Polite, Newbury, Vt.; Michael Tully, Staten Island, N.Y.

[73] Assignee: Inopak Ltd., Mahwah, N.J.

[21] Appl. No.: 526,445

[22] Filed: May 24, 1990

[51] Int. Cl.[5] ..... B67D 5/06

[52] U.S. Cl. ..... 222/181; 222/325

[58] Field of Search ..... 222/94, 95, 105, 181, 222/185, 214, 325; 141/386; 285/330

[56] References Cited

U.S. PATENT DOCUMENTS

| | | | |
|---|---|---|---|
| 3,912,125 | 10/1975 | Acklin | 222/181 X |
| 4,429,812 | 2/1984 | Steiner | 222/181 |
| 4,457,712 | 7/1984 | Dragan | 222/391 X |
| 4,564,125 | 1/1986 | Esslinger | 222/456 X |
| 4,627,476 | 12/1986 | Wilcke | 222/325 X |
| 4,634,022 | 1/1987 | O'Halloran et al. | 222/181 X |
| 4,974,753 | 12/1990 | Tucker et al. | 222/325 X |

FOREIGN PATENT DOCUMENTS

| | | | |
|---|---|---|---|
| 701809 | 1/1954 | United Kingdom | 222/181 |

*Primary Examiner*—Michael S. Huppert
*Assistant Examiner*—Gregory L. Huson
*Attorney, Agent, or Firm*—Kenyon & Kenyon

[57] ABSTRACT

A fixture for fluid dispensing bags having lower portions with nozzles. The bags are used with the lower portions folded forwardly and the nozzles pointed downwardly. The nozzles form keys which differ for different groups of the bags. The fixture has a forwardly extending shelf for the lower portions of the bags and in which a hole is formed and an insert is positioned in the hole and has a nozzle hole forming a key hole fitted by the nozzles of only one group of the bags.

2 Claims, 4 Drawing Sheets

FIXTURES FOR FLUID DISPENSING BAGS

This invention relates to fixtures for fluid dispensing bags of the type made of flexible plastic, contain fluid such as soft soap, and are hermetically sealed by the manufacturer. For use such a bag is hung by its top and its lower portion is folded forwardly and has a dispensing valve providing a downwardly pointing dispensing nozzle.

The fixtures are of the type having an upstanding wall on which the bag is hung and a forwardly extending shelf having a hole for the bag's nozzle when the bag's lower portion is folded forwardly on the shelf.

One group of bags may contain antiseptic soap and another group may contain ordinary soap. A bag of one group should not be substituted by a bag from another group. Fluids other than soft soap may be involved.

To prevent such substitution the nozzle hole of each fixture has an axially extending groove and the nozzles of the group of bags intended for that fixture each have an axially extending rib with the groove and ribs circumfertically oriented the same way. A group of bags not intended for that fixture have nozzles with ribs otherwise circumfertically oriented and cannot fit the nozzle hole of that fixture.

The problem with the above is that there must be a different fixture for each group of bags, requiring large inventories of different fixtures.

To briefly summarize this invention only one fixture is used for all of the bags, this fixture having its nozzle hole formed by an insert fixed in the hole in the fixtures shelf. This insert is installed in the shelf hole with the nozzle hole groove circumferentially oriented the same as the ribs of the nozzles of the group of bags intended for that fixture. The insert is then press-fitted in the shelf hole so firmly that the insert cannot be turned or removed once it is installed with the appropriate orientation for the group of bags for which the fixture is intended.

The fixture has a removable cover for the bag and its forwardly folded position and the cover has an actuator for the bag's valve.

Referring to the accompanying drawings.

Figure 8:
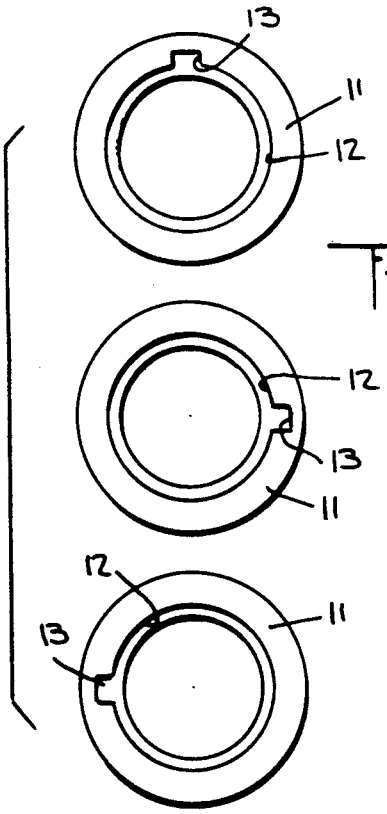
Figure 6:
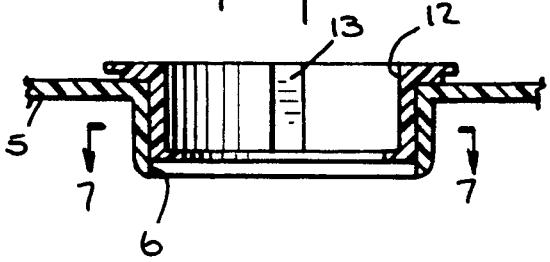
FIG. 6 is a cross section showing the installed insert.
Figure 9:
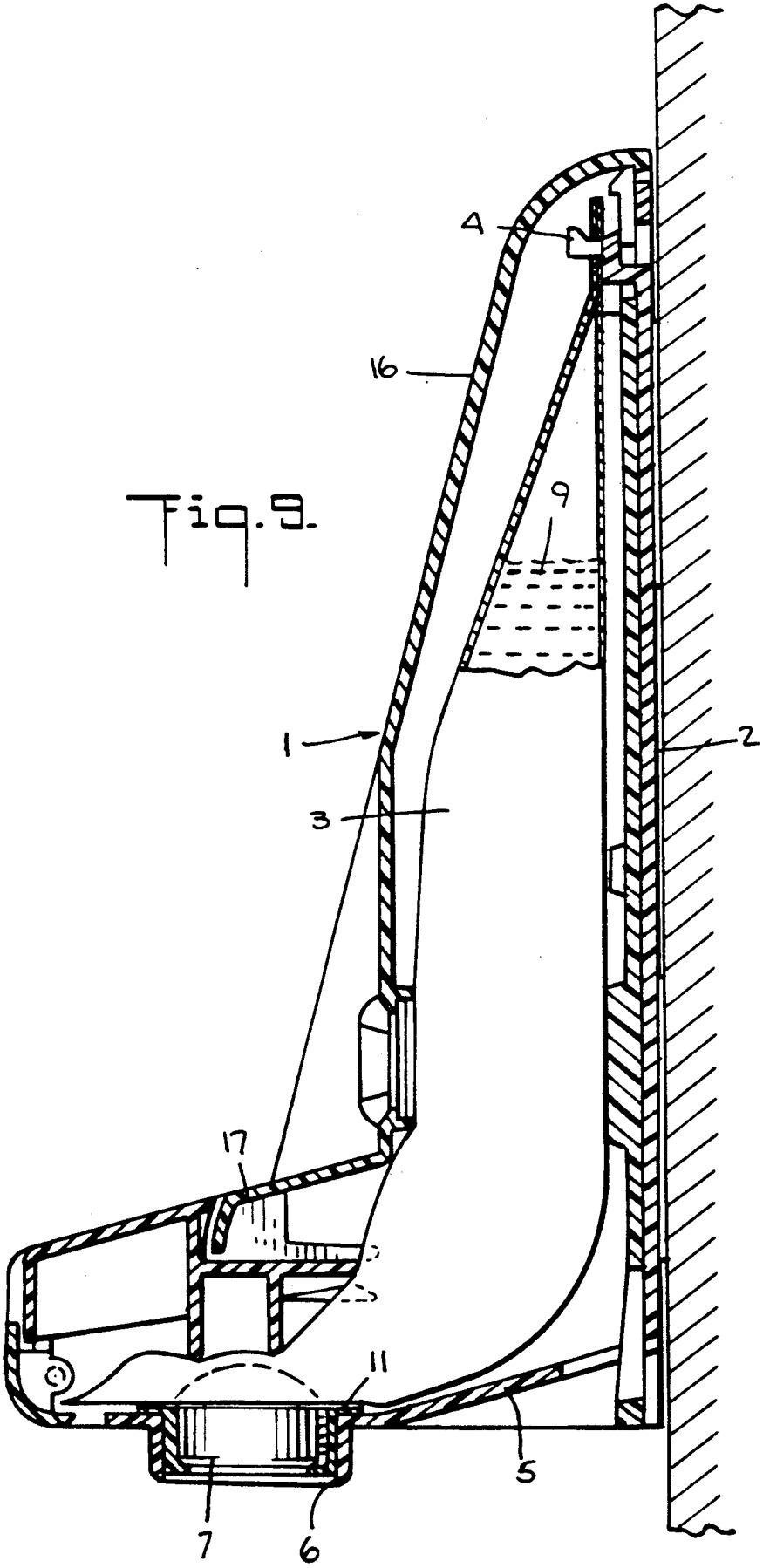

FIG. 8 schematically shows how the insert can be installed in the fixture's shelf at differently oriented positions; and FIG. 9 is a vertical section of the fixture with the bag in position.

More specifically the above drawings show the fixture 1 with its upstanding wall 2 on which the bag 3 is hung by hooks 4 and the forwardly extending shelf 5 having a hole 6 for the bag's nozzle 7, with the bag's lower portion 8 folded forwardly on the shelf 5. The bag contains soft soap 9 to be dispensed through its downwardly pointing nozzle 7. The nozzle has the rib 10 circumferentially oriented according to the bag's content.

Figure 5:
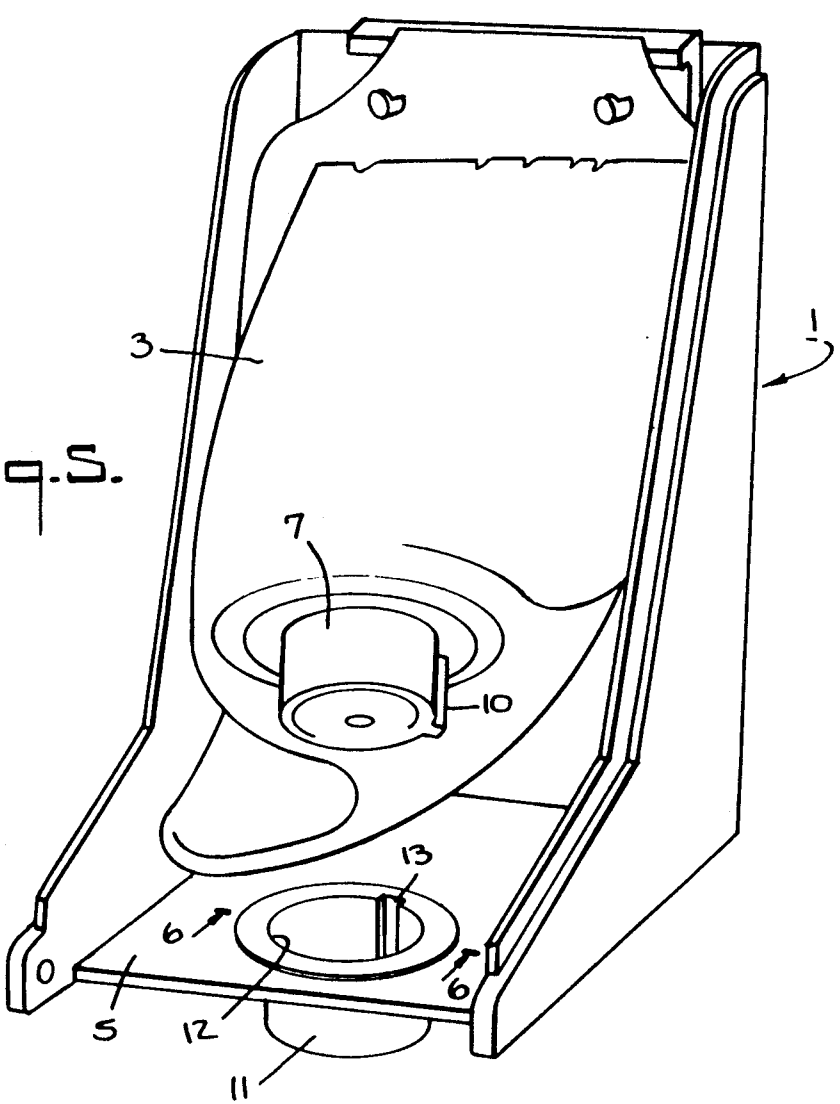
FIG. 5 is a perspective view showing the fixture with its cover removed and the insert installed.
Figure 1:
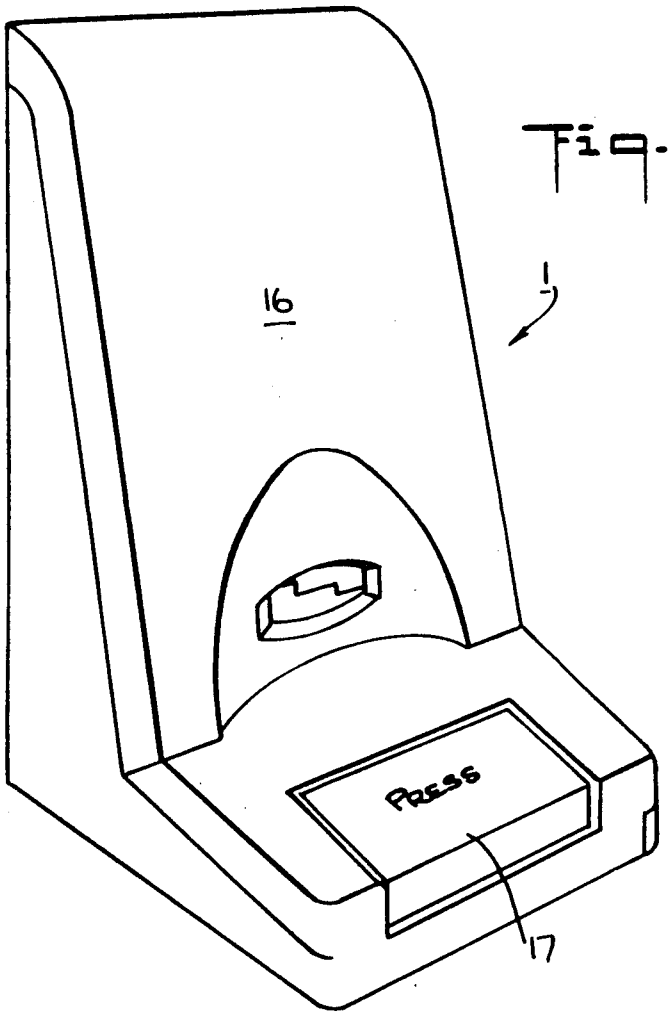
FIG. 1 is a perspective view showing an example of the fixture.
Figures 2, 3:
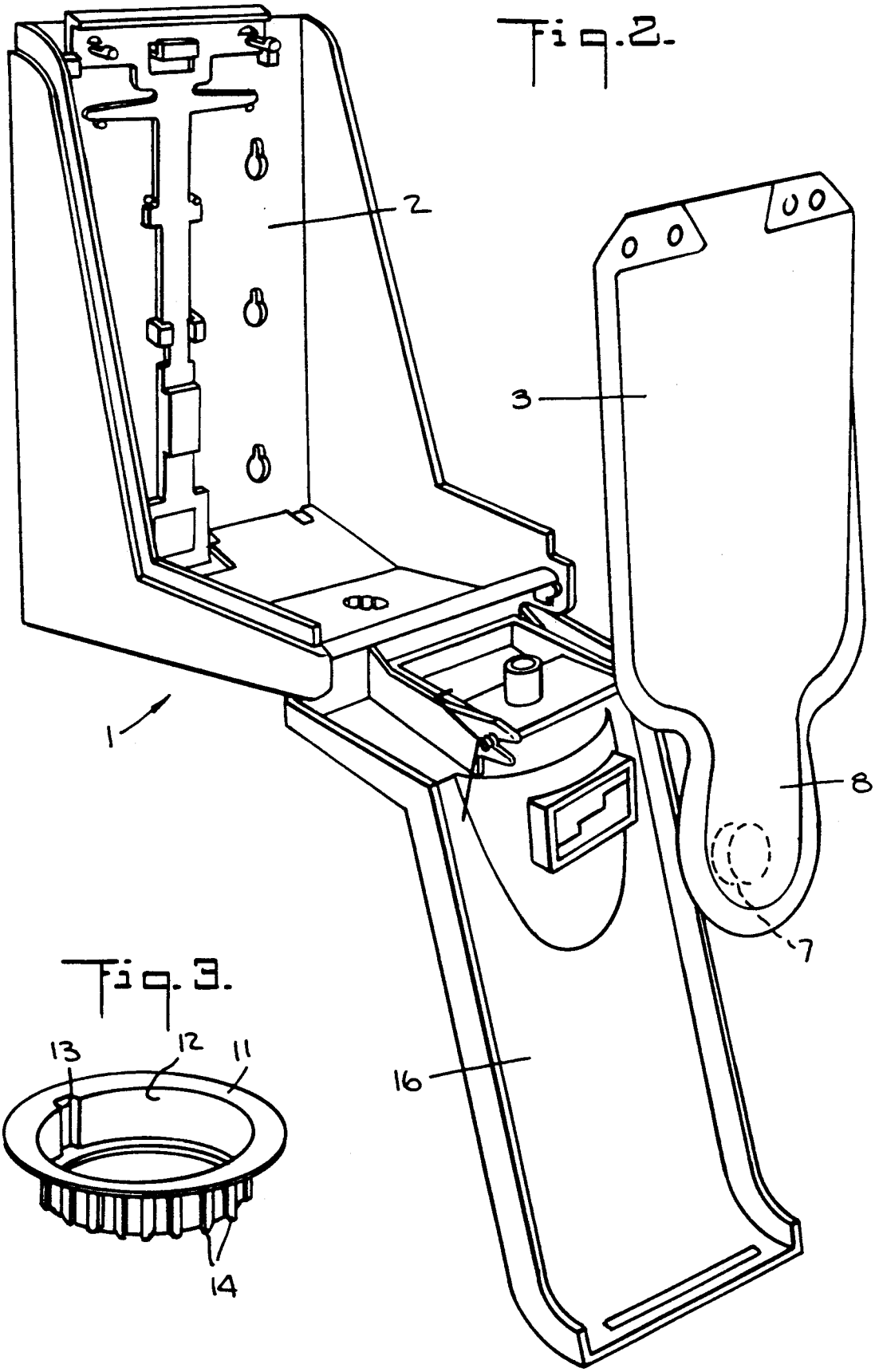
FIG. 2 is perspective view showing the fixture's cover open and one of the bags about to be installed.
FIG. 3 is a perspective view showing one of the inserts providing the nozzle hole.
Figure 4:
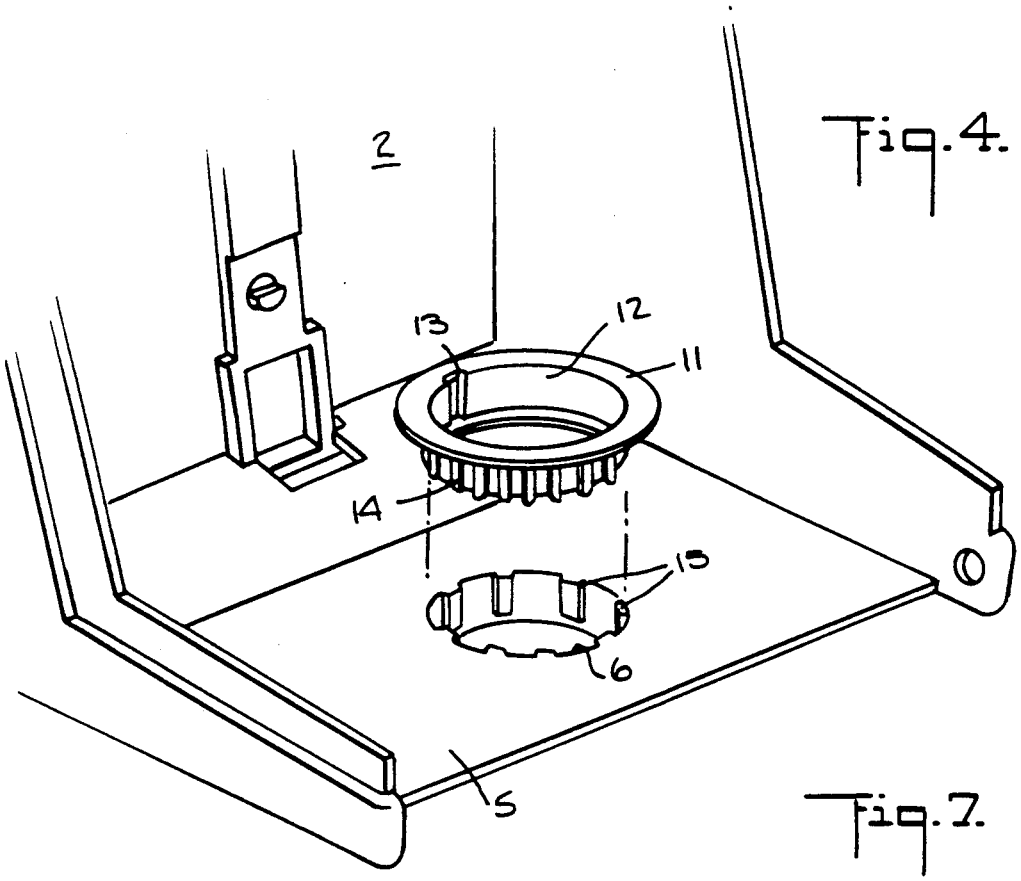
FIG. 4 is a perspective view showing the fixture's shelf with one of the inserts being installed.
Figure 7:
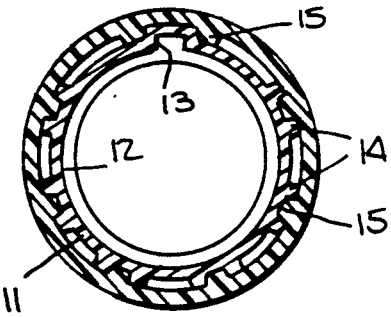
FIG. 7 is a cross section taken on the line 7—7 in FIG. 6.

The fixture's shelf-hole 6 is provided with the insert 11 forming the nozzle hole 12 with its groove 13. FIG. 4 shows the insert about to be inserted in the fixture's shelf hole 6. The insert is first rotated to make its groove circumferentially matched with the rib of the bag's nozzle, and the insert is then press-fitted non-removably in the shelf hole. The nozzle forms a key and the insert a key hole. A bag having a differently keyed nozzle cannot fit the insert's key hole.

The insert has an axially ribbed periphery 14 and the shelf hole has corresponding grooves 15, so the insert is not only non-removable but more positively non-rotative when press-fitted in the shelf-hole. There must be an insert for each of the bags but the inserts are inexpensive as compared to the cost of the fixture.

The fixture has a removable cover 16 for the hanging bag and its forwardly folded lower portion. The cover has an actuator 17 for the valve's operator.

We claim:

1. A fixture for a fluid dispensing bag made of flexible plastic and containing fluid and used with its lower portion folded forwardly and having a dispensing valve providing a downwardly pointing dispensing nozzle, the fixture comprising an upstanding wall on which the bag is hung and a forwardly extending shelf having a hole fitted with an insert forming a nozzle hole for the bag's nozzle, the nozzle hole having an axially extending groove and the nozzle having an axially extending rib, the groove and rib requiring similar circumferential orientation for the nozzle to be inserted in the nozzle hole; said insert fitting the hole in the shelf when the insert is in any of a plurality of rotative positions and having means for fixing it in the hole non-rotatively in any of the positions.

2. The fixture of claim 1 in which the insert has an axially ribbed periphery and the hole in the shelf has corresponding grooves, and said means is provided by the insert being press-fitted in the hole in the shelf.

* * * * *